US005669250A

United States Patent [19]

Dausch et al.

[11] Patent Number: 5,669,250

[45] Date of Patent: Sep. 23, 1997

[54] WASHING MACHINE FILL CONTROL SYSTEM

[75] Inventors: Mark Edward Dausch, Latham; Walter Whipple, III, Amsterdam; Vivek Venugopal Badami, Niskayuna; Harold John Jenkins, Jr., Amsterdam, all of N.Y.

[73] Assignee: General Electric Company, Schenectady, N.Y.

[21] Appl. No.: 717,593

[22] Filed: Sep. 23, 1996

Related U.S. Application Data

[63] Continuation of Ser. No. 496,115, Jun. 28, 1995, abandoned.

[51] Int. Cl.[6] ..... D06F 33/02; D06F 39/08

[52] U.S. Cl. ..... 68/12.02; 68/12.04; 68/12.19; 68/207

[58] Field of Search ..... 68/12.02, 12.04, 68/12.05, 12.19, 12.21, 23.5, 207

[56] References Cited

U.S. PATENT DOCUMENTS

| | | | |
|---|---|---|---|
| 4,303,406 | 12/1981 | Ross | 68/207 X |
| 4,480,449 | 11/1984 | Getz et al. | 68/12.02 |
| 4,481,786 | 11/1984 | Bashark . | |
| 4,607,408 | 8/1986 | Didier et al. | 8/159 |
| 4,754,622 | 7/1988 | Fanson | 68/207 |
| 4,862,710 | 9/1989 | Torita et al. . | |
| 5,031,426 | 7/1991 | Wilson | 68/207 |
| 5,042,276 | 8/1991 | Kamano et al. . | |
| 5,130,624 | 7/1992 | Bashark . | |
| 5,144,819 | 9/1992 | Hiyama et al. | 68/12.04 |
| 5,161,393 | 11/1992 | Payne et al. | 68/12.04 |
| 5,208,931 | 5/1993 | Williams et al. | 68/12.04 X |
| 5,230,228 | 7/1993 | Nakano et al. . | |
| 5,233,847 | 8/1993 | Tanaka | 68/12.04 |
| 5,237,256 | 8/1993 | Bashark . | |
| 5,241,845 | 9/1993 | Ishibashi et al. . | |
| 5,275,025 | 1/1994 | Nakamura et al. | 68/12.04 |
| 5,291,626 | 3/1994 | Molnar et al. | 8/158 |
| 5,293,760 | 3/1994 | Tani et al. | 68/12.02 |
| 5,313,964 | 5/1994 | Dausch et al. | 134/57 D |
| 5,330,580 | 7/1994 | Whipple, III et al. | 134/18 |
| 5,408,716 | 4/1995 | Dausch et al. | 8/158 |

FOREIGN PATENT DOCUMENTS

| | | |
|---|---|---|
| 415743A1 | 3/1991 | European Pat. Off. . |

*Primary Examiner*—Philip R. Coe
*Attorney, Agent, or Firm*—Donald S. Ingraham

[57] ABSTRACT

An energy efficient washing machine includes a cleansing fluid supply system, a washer basket having an agitator device for displacing the articles to be cleansed within the basket, and a closed loop water level controller coupled to the cleansing fluid supply system and to the drive system for the agitator. The fluid supply system includes a fill nozzle designed to provide a clothes-positioning spray pattern that serves to maintain the articles evenly distributed in the basket to enables the load sensing systems of the closed loop adaptive water level controller to function to accurately provide the optimal water level for cleansing. To accomplish this positioning of the articles to be cleansed, the fluid fill nozzle typically provides a fan discharge of fluid passing therethrough and is disposed at a cant angle with respect to the direction of rotation of the basket such that the fan discharge covers an area between the agitator assembly and the sidewall of the basket.

16 Claims, 4 Drawing Sheets

WASHING MACHINE FILL CONTROL SYSTEM

This application is a Continuation of application Ser. No. 08/496,115 filed Jun. 28, 1995 now abandoned.

BACKGROUND OF THE INVENTION

This invention relates generally to energy efficient washing machines for cleansing clothes and similar articles and more particularly to washing machines that use only the optimal amount of water that is required for the size of the load of articles to be cleaned.

Optimizing energy usage of household appliances holds the potential for collectively providing significant energy savings. In conventional washing machines, for example, the amount of water that the machine uses in a washing cycle is determined by the operator via a manual control, such as a load size selector switch. Such manual controls typically offer a limited number of selections (e.g., small, medium, or large); such selections may not offer a load size option appropriate for a given load. It is also common that a larger size load is selected than is actually needed to achieve effective cleaning of the articles to be washed. Use of more water than is needed for effective cleaning leads to a waste of water and of energy used to heat and circulate the water.

Automated control of water added to the washer during a wash cycle has been suggested as one means of minimizing energy usage in a washer. Important factors in determining the appropriate amount of water to provide effective cleaning is the weight (or mass) of the articles to be cleaned and the nature of the fabrics (such as synthetics or cottons) because different fabric types absorb different amounts of water.

SUMMARY OF THE INVENTION

In accordance with this invention, an energy efficient washing machine includes a control system that provides a cleansing fluid level that is optimized for effective cleaning of the soiled articles while also reducing water consumption of the machine compared with conventional manual fluid level control machines. The washing machine includes a cleansing fluid supply system, a washer basket having an agitator device for displacing the articles to be cleansed within the basket, and a closed loop water level controller coupled to the cleansing fluid supply system and to the drive system for the agitator. The fluid supply system includes a fill nozzle designed to provide a clothes-positioning spray pattern that serves to maintain the articles in the basket in a position and condition (wetted) that enables the load sensing programs of the closed loop adaptive water level controller to function to accurately provide the optimal water level for cleansing.

The closed loop water level controller is responsive to the load of articles disposed in the basket of the washer and includes a washer load determining system that controls rotation cycles of the agitator (that is, movement of the agitator within the basket) to displace the articles and water in the basket. The load signature of the agitator is processed by the controller to determine the optimal fill level. Accurate agitator work signatures are obtained when the articles in the basket are wetted down and distributed substantially evenly along radially in the basket so that they are in a position to be displaced by the action of the agitator during the rotation cycles commanded by the load determining system. To accomplish this positioning of the articles to be cleansed, the fluid fill nozzle typically provides a fan discharge of fluid passing therethrough and is disposed at a cant angle with respect to the direction of rotation of the basket such that the fan discharge covers an area between the agitator assembly and the sidewall of the basket. Alternatively, fill nozzle comprises a spray head providing a water plume having the desired clothes-positioning spray pattern.

BRIEF DESCRIPTION OF THE DRAWINGS

The features of the invention believed to be novel are set forth with particularity in the appended claims. The invention itself, however, both as to organization and method of operation, together with further objects and advantages thereof, may best be understood by reference to the following description in conjunction with the accompanying drawings in which like characters represent like parts throughout the drawings, and in which:

DETAILED DESCRIPTION OF THE INVENTION

Figure 1:
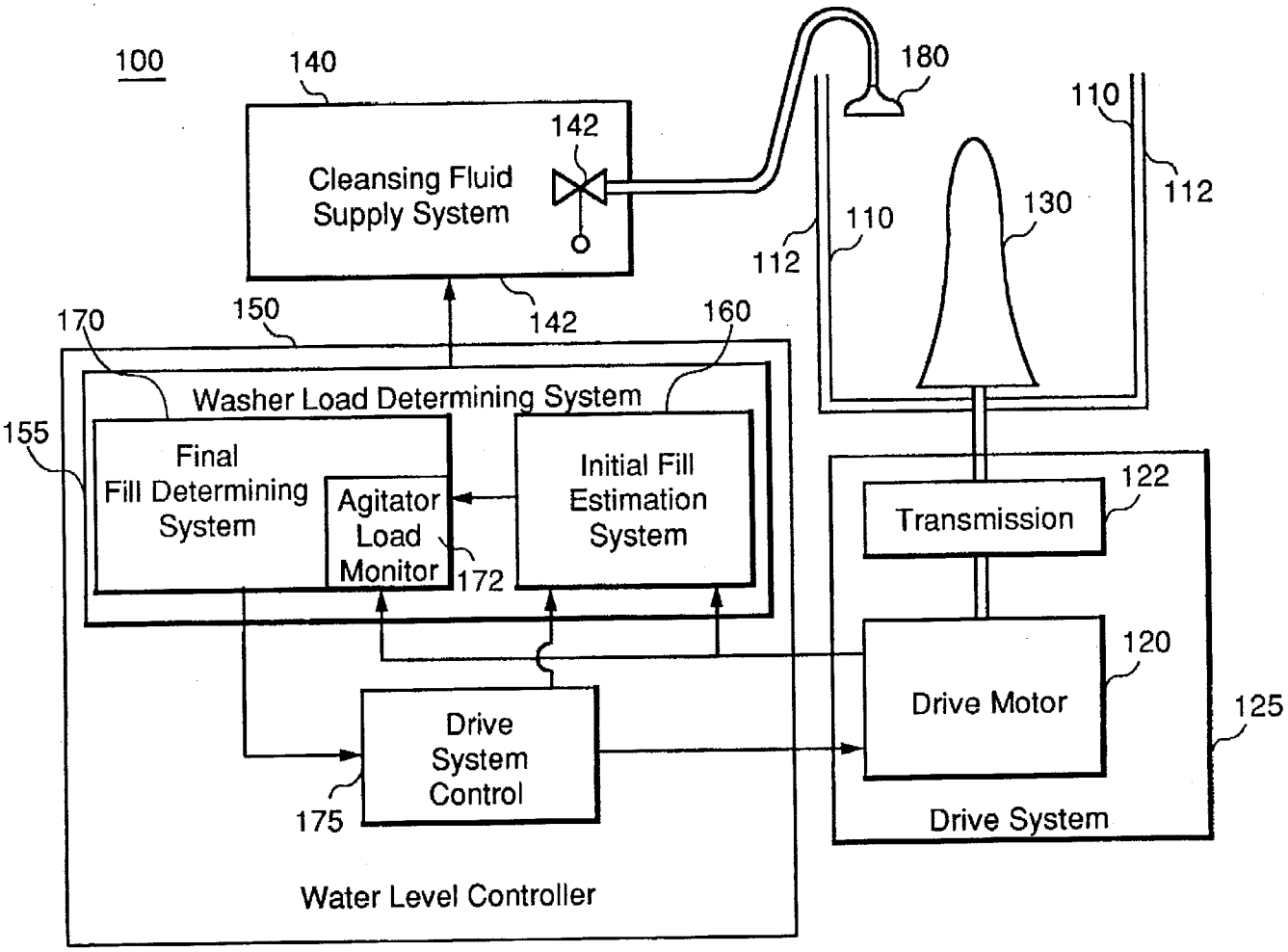
FIG. 1 is a block diagram of a washing machine in accordance with this invention.

A washing machine 100 comprises a washer basket 110 that is movably disposed within a washer tub 112; washer basket 110 is further coupled to a drive system 125 so as to allow rotation of basket 110 within tub 112. Drive system 125 comprises, for example, a drive motor 120 and a transmission 122 that may further include drive belts, gearing, and the like that translate the rotational motion of the drive motor shaft into the desired motion of components within washing machine 100; alternatively, in some arrangements motor 120 can be coupled to directly drive components of machine 100 without a transmission. An agitator device 130 is further disposed within basket 110 and is coupled to drive system 125 such that it can be rotated or displaced within basket 110. As used herein, "agitator device" or "agitator" refers to an apparatus that imparts oscillatory motion to the articles and cleansing fluid within basket 110; for example, agitators commonly have vanes and the like mounted on a columnar structure, but alternatively may comprise pulsator or impeller devices that induce desired motion in the articles and water within basket 110. A cleansing fluid supply system 140 is disposed so as to provide a cleansing fluid to fill tub 112 and basket 110 (basket 110 typically is perforated, which allows fluid communication between tub 112 and the interior of basket 110). A closed loop water level controller 150 that is responsive to the load of articles to be cleansed is coupled to cleansing fluid supply system 140 and to drive system 125 and is adapted to generate a control signal for fluid supply system 140 to provide an optimal fill level for the cleansing fluid in basket 110 during wash cycles of machine 100. Further, in accordance with this invention, the cleansing fluid is passed to basket 110 though a fluid fill nozzle 180 that is disposed to provide a clothes-positioning spray pattern. This spray pattern serves to wet and position the articles within the basket such that the articles are in a position to be displaced by action of agitator 110 during operations to determine the load of articles to be cleansed which in turn is used to control cleansing fluid supply system 140 so as to provide the optimal fill level.

As illustrated in FIG. 1, washing machine 100 comprises a vertical axis washer, that is, the rotation of basket 110 and agitator 130 is about a vertical axis. Effective cleansing of the articles in the washing machine requires an adequate amount of water (although other cleansing fluids can be used, water is the most common and is used herein by way of example and not limitation), which is typically referred to as the "fill level," that is, the level in the basket 110 to which the water is filled. Examples of measures of washing machine performance include the turnover adequacy of the machine, a soil removal index, the mechanical action performance (with respect to the articles agitated in the basket), a tangling index, and measurements such as no excessive splashing of water in the basket. Effective cleansing of the articles, as indicated by each of such measures, depends to a large extent on having an optimal level of water in the machine; if the water level is too low, the articles to be cleaned are subject to significant stress due to mechanical displacement by the agitator; the addition of too much water may cause some articles to float and thus have decreased interfacial wash action, with the consequence that water is wasted (along with the energy to heat, pump, and agitate the water) and the articles do not receive the desired motion within the basket for optimal cleaning or rinsing. Further, optimal water level should provide an adequate detergent dilution ratio to ensure that in the articles to be cleansed are appropriately cleaned.

Closed loop water level controller 150 is adapted to provide an optimal fill level for each load of articles that is washed. The optimal fill level provides: adequate turnover (typically the standard is that identified items in a wash are circulated top to bottom and back (or vice versa) within each wash operation) (one example of such a test protocol is the Consumer's Union turnover test); adequate cleanliness of the articles washed (e.g., as measured by the soil removal index based on change in reflectivity of soiled articles before and after washing); washing action that does not damage the clothing articles (e.g., at an appropriate index, such as one determined by the Danish Mechanical Action Test); an acceptable tangling index (e.g., as measured by the intertwining of multiple long-sleeved shirts after washing); and, no splashing of water out of the machine during agitation.

Controller 150 comprises a washer load determining system 155 that is adapted to control rotation cycles of agitator 130 to displace articles and water in basket 110 so as to determine the load of those articles and generate a signal to control the addition of water to basket 110 from cleansing fluid supply system 140. Washer load determining system comprises a final fill determination system 170 that is coupled to receive an agitator work signature signal from drive system 125 via a load signature monitor 172, and further coupled to control rotation cycles of agitator 130 via a drive system control module 175.

Drive system 125 is adapted to drive agitator 130 in an oscillatory motion. For example, an oscillatory agitation cycle typically involves a forward stroke followed by a reverse stroke, with the agitator arc and velocity during each stroke being determined by drive system 125 (for example, set in the fabrication process by reason of the selection of gearing in transmission 122 and the operating characteristics of drive motor 120). The articles disposed in basket 110, together with the water in the basket that is displaced by the agitator as it oscillates, create a reactive torque on agitator 130 which provides an agitator load signature that is reflective of the work being expended to displace the agitator, articles to be cleansed, and water in the basket. Such an agitator load signature is further evidenced in a corresponding reactive torque on drive system 125. Further, this reactive torque on drive system 125 varies such that the amount of reactive torque on drive motor is least near the optimal water level, that is, a water level that is sufficient to provide effective cleansing of the articles in basket 110. At less than the optimal water level, the reactive torque on agitator 130 (and hence drive system 125) is greater than that seen at the optimal water level due to the work required of the agitator to mechanically displace the clothing (without the "lubrication" of sufficient water to facilitate movement of the articles); agitation at less than the optimal water additionally has deleterious effects on the articles themselves. At higher than the optimal water level, the reactive torque on agitator 130 (and drive motor 120) is also greater than the level of reactive torque experienced at the optimal water level due to the displacement of the extra mass of water beyond that required for adequate turnover.

One example of a final fill determination system is provided in the copending application entitled "Adaptive Water Level Controller for Washing Machine" Ser. No. 08/496,114, filed concurrently with the instant application, assigned to the assignee herein, and incorporated herein by reference. Such an adaptive water level controller processes agitator work load signature information to determine a point at or near the agitator minimum work point, which point temporally coincides with the optimal fill level. The desired fill level is thus determined and obtained for each individual load of wash taking into account all variables affecting the optimal fill level, such as the mass of clothes, the nature of the fabric, the water temperature, and so forth. Agitator work load signature monitor 172 is responsive to signals that are direct or, alternatively, indirect measurements of the reactive torque on agitator 130 during commanded rotation cycles during the water filling process. Direct measurements can include agitator as determined by a torque sensor (e.g., a strain gage) (not shown) coupled to the drive shaft of agitator 130. Indirect measurements can include electrical parameters of drive system 125, such as the phase angle of an AC induction drive motor 120, or measurement parameters (e.g., current, voltage, and motor power consumption measurements) of torque-command motors (also referred to generically as controlled speed motors) such as electronically commutated motors (ECM), switched reluctance motors (SRM), universal motors, or the like.

Final fill determination system 170 comprises a closed feedback control system in which the agitator load signature is received by monitor 172 (such as by measurement of motor load through motor phase angle information). Agitator load signature (e.g., drive motor 120 phase angle information) is used for determining the optimal water level for a particular load of articles to be cleansed. Accurate determination of agitator work load, and hence accurate determination of the optimal fill level for a given load in basket 110, requires that the articles disposed in basket 110 be wetted down and disposed substantially evenly across the bottom of basket 110 such that they are in a position to be displaced during the rotation cycles of agitator 130 that are used to determine reactive torque and hence optimal fill level.

In accordance with this invention, fluid supply system 140 comprises fluid fill funnel 180 disposed at a water addition station 182 on washer 100 so as to provide a clothes-positioning spray pattern 190 (FIGS. 2 and 3) for water dispensed into basket 110. Clothes-positioning spray pattern 190 serves to wet the clothes and distribute the clothes substantially evenly between a basket sidewall 114 and agitator assembly 130. As used herein, "clothes-positioning," "wetted down" and the like refer to exposing the fabric of the articles to be washed to water (or alternatively, other cleansing fluid) so that the fabric absorbs the cleansing fluid to become saturated. Additionally, one potential problem with failing to adequately wet the fabric during the fill operation is that the dry portion of the fabric absorbs water when wetted after the machine has progressed to the wash portion of the cycle. The water absorbed by the previously non-wetted fabric can reduce the fill level of water below the optimal level. The amount of water absorbed depends on the type of fabric; e.g., cottons absorb an amount of water up to five times the weight of the fabric, whereas synthetics absorb hardly any water.

Wetting down of the articles in basket 110 is accomplished in part by drive system control system 175 (FIG. 1) generating a signal that commands the rotation of basket 110 during the fill process in between periods when agitator 130 is being operated to obtain agitator work load information. By "jogging" (or rotating incrementally) basket 110, all of the articles in the basket are periodically exposed to the clothes-positioning spray pattern so that all of the articles in the load become saturated with water in order to provide an accurate agitator work load signature. The increments that the basket is rotated is selected to optimize clothes wetting without causing undue wear on drive system 125 components from the frequent stopping and starting. Basket 110 is typically rotated between one-half and three quarters of a turn; for example, a rotation in the range between about 100° and 110° serves to wet the clothes and position a different portion of the basket under fill funnel 180 after each jogging of the basket.

Figure 2:
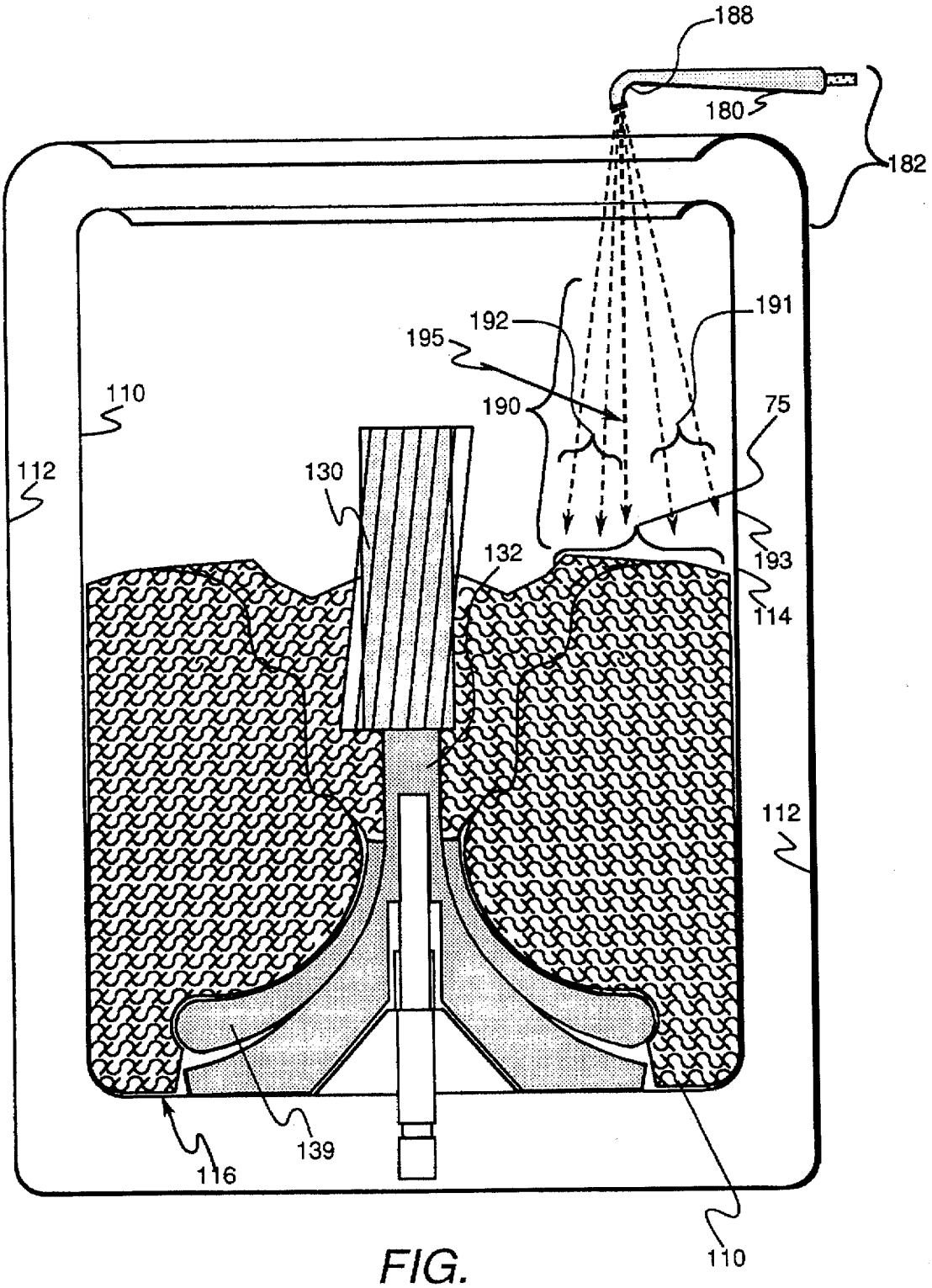
FIG. 2 is a side view of a washer assembly with a fluid fill nozzle in accordance with this invention.
Figure 3:
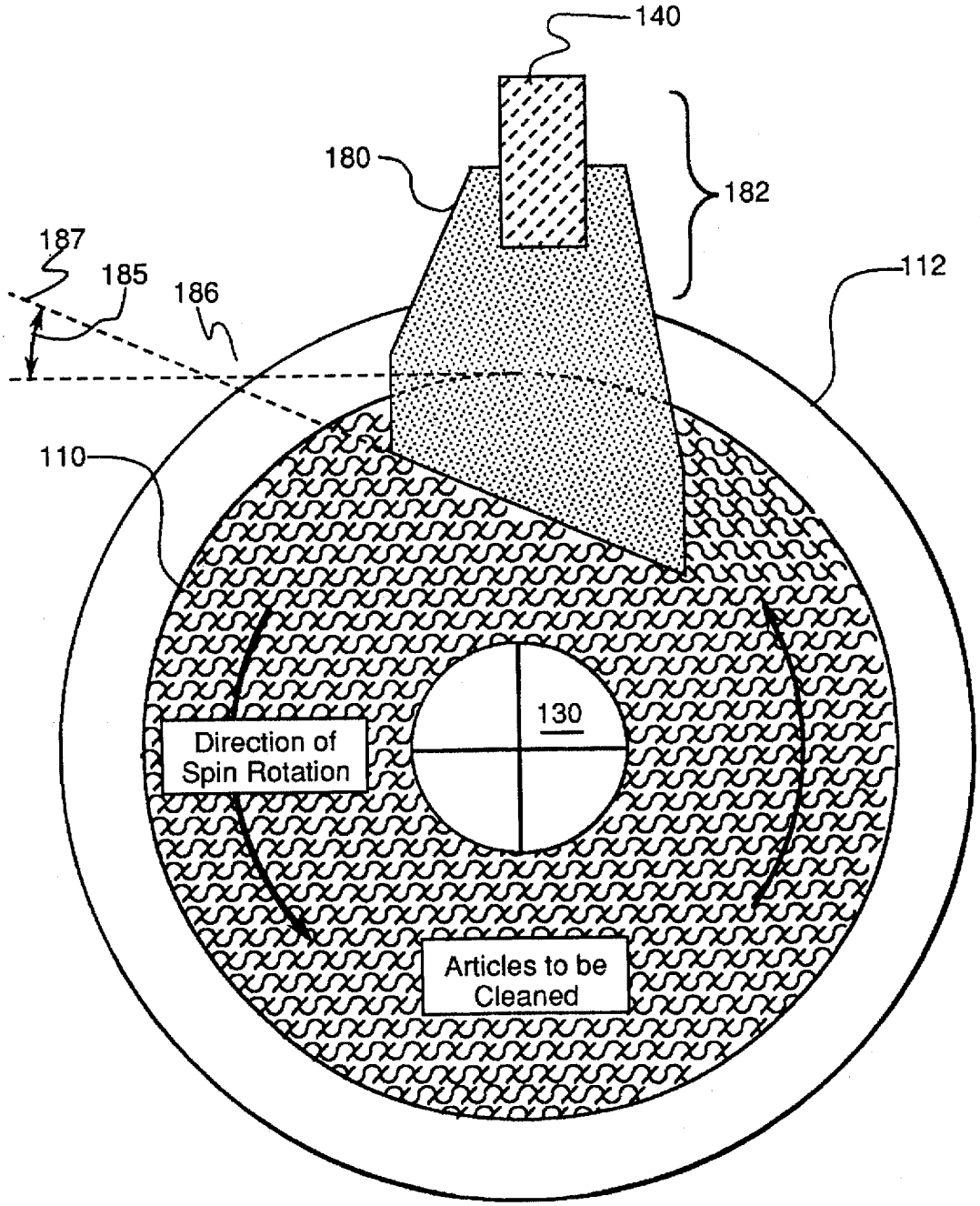
FIG. 3 is a top view of a washer assembly with a fluid fill nozzle in accordance with one embodiment of this invention.

Additionally, the articles to be washed are desirably substantially evenly disposed between sidewall 114 of basket 110 and agitator assembly 130 such that they are displaced (along with surrounding water) as agitator 130 oscillates during rotation cycles commanded by controller 150. "Substantially evenly distributed" refers to articles in the basket in which the volume of the articles is more or less evenly distributed radially in basket 110 (the radial distribution of weight may vary dependent upon the type of articles, such as a cotton towel in a load with a synthetic article of clothing may result in an uneven radial weight distribution at any given moment during filling of the basket). As illustrated in FIG. 2, in one embodiment agitator 130 comprises a central columnar structure 132 having a plurality of vanes 139 extending therefrom into the basket volume. As agitator 130 oscillates, vanes 139 move and displace the articles (and water) in basket 110. As noted above, for accurate determination of the reactive torque on agitator 130 during rotation cycles commanded by controller 150, it is important that the articles be in a position so that they are displaced by the rotation of agitator 130; if the articles became bunched up (or compacted against) sidewall 114 of basket 110, the reactive torque on agitator 130 would not accurately represent the clothes loading in basket 110 for a given wash cycle, with the result that the amount of water added for that wash would not be optimal (e.g., in the situation noted, controller 150 would detect a lighter load than actual and hence not fill basket 110 with sufficient water for optimal cleaning of the articles).

In accordance with this invention, fill funnel 180 comprises a flared nozzle that produces a fan discharge flow of fluid passing through the funnel. "Fan discharge flow" and the like refer to a spray pattern emanating from nozzle 180 that deposits water radially across the interior of basket 110. In one embodiment, the fan discharge flow from flared nozzle 180 comprises a waterfall-type discharge oriented so that the water passing from the nozzle directly wets items at a number of radial points in the basket. Further, flared nozzle 180 is disposed at a cant angle 185 with respect to the direction of rotation of basket 110 so that the spray pattern from nozzle 180 does not fall into basket 110 at only one spot along the radius of basket 110 but rather covers a path extending at least part way between agitator 130 and sidewall 114 of basket 110. In this way, a greater portion of an upper surface area 75 of articles in basket 110 is exposed to the water being dispensed into basket 110.

Cant angle 185 refers to the orientation of nozzle 180 such that the axis of the fan discharge of water passing from the nozzle is disposed along several radial points between agitator 130 and basket sidewall 114. In one embodiment as illustrated in FIG. 2, cant angle 185 can be illustrated as the angular orientation between a tangent line 186 drawn from sidewall 114 at water addition station 182 along the direction of rotation of basket 110 and a fill nozzle axis 187 aligned with an averaged direction orientation of the clothes-positioning spray pattern 190. For the embodiment shown in FIG. 2, cant angle 185 is in the range between about 10° and about 30°, and typically is in the range of about 15° to about 20°, which represents a design compromise between providing an adequate clothes-positioning spray pattern (a spray pattern disposed along a radius of basket 110 would be optimum from this standpoint) and providing adequate access for the operator of the machine to add and remove clothes from basket 110 (a conventional single radial point addition nozzle position 195 is optimal from this standpoint).

Clothes-wetting spray pattern 190 comprises a first portion 191 (e.g., a part of the stream of water passing from nozzle 180) that is directed towards sidewall 114 of basket 110 along a path so as to impinge (or intersect in the absence of an article in basket 110 interposed along the path) sidewall 114 at a washdown position 193. Washdown position 193 is typically located along sidewall 114 at a point at least about halfway up sidewall 114 (as measured away from the bottom of basket 110 and towards the top of basket 110), and is typically located at a point in the range between one-half and three-quarters of length of sidewall 114. Washdown position 193 is located within the same quadrant (e.g., within 90°) of the position of water addition station 182 with respect to basket 110. To achieve the projection of water in the fan discharge path towards washdown position 193 on sidewall 114, nozzle 180 typically comprises a curled lip 188 on the portion of the nozzle disposed in closest proximity to sidewall 114. Curled lip 188 is disposed in the stream of water passing from the nozzle so that water is deflected off of a vertical drop path (e.g., path 195) and back towards the portion of sidewall 114 disposed in proximity to nozzle 180.

Further, a second portion 192 (e.g., part of the stream of water passing from nozzle 180) is directed radially inward in the basket, that is, projected to cover a portion of basket 110 (and articles contained therein) that are disposed radially closer to the center of basket 110. In the embodiment shown in FIG. 2, agitator 130 is disposed in the center of basket 110, thus second portion 192 of clothes-positioning spray pattern covers the portion of the basket (and articles disposed therein) that is radially closer to agitator 130 than the conventional radial point addition nozzle position. Typically, the path along which second portion of spray pattern 190 is directed is aligned such that it would impinge on agitator 130 near the bottom of tub 110; when basket 110 is loaded with articles to be cleansed, the spray pattern typically does not reach the agitator before striking an article in the basket.

By way of example and not limitation, flared nozzle 180 in a typical large capacity washing machine (e.g., having a capacity in the range of about 2.5 $ft^3$ to 3.5 $ft^3$, with a load capacity of up to about 15 lb.) would typically comprise a plastic material and have a discharge nozzle length (that is, the open portion of the nozzle from which the water passes into the basket) in the range of between about 2 inches and 6 inches. The nozzle is oriented at a cant angle in the range between about 15° and 20° and provides a clothes-positioning spray pattern having a washdown position 193 located about half along the length of sidewall 114; the spray pattern also effectively exposes articles disposed in basket 110 (the basket having a radius of about 9 inches between agitator 130 at the center and sidewall 114 about halfway along the length of the sidewall) to water so as to the articles to be cleansed are substantially evenly distributed within basket 110.

Figure 4:
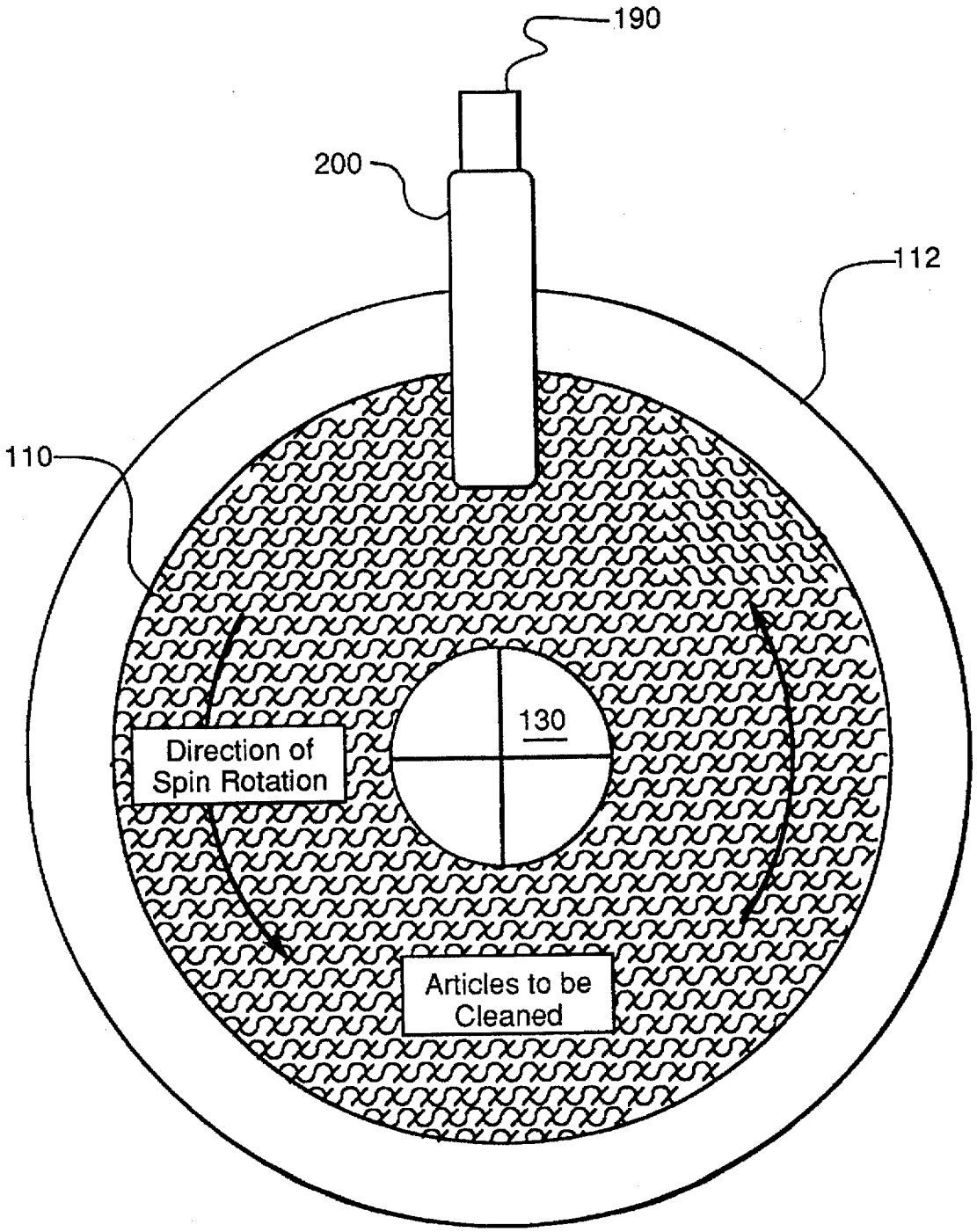
FIG. 4 is a top view of a washer assembly with a fluid fill nozzle in accordance with another embodiment of this invention.

Alternatively, fill funnel 180 may comprise a nozzle spray head 200 (FIG. 4) having a plurality of spray ports (not individually shown) from which the water emerges in a diverging (or expanding) pattern; in this embodiment, wetting of clothes at various points along the radius of basket 110 is accomplished through selecting the orientation (e.g., in fabricating the nozzle) of individual ports in the nozzle so as to direct the spray in directions to provide the clothes-positioning spray pattern similar to that illustrated in FIG. 2.

In a further alternative embodiment, washer load determining system further comprises an initial fill estimation system 160 (FIG. 1) that generates a signal to control cleansing fluid supply system 140 to add a determined amount of water to basket 110 prior to final fill determination system commanding rotation cycles of agitator 130 to determine the (final) optimal fill level of water in basket 110 prior to starting the wash cycle. It is desirable that some amount of water be added to basket 110 prior to initiating rotation cycles of agitator 130 (in accordance with the fill control program of final fill determination system 170) both to prevent damage to the articles in the basket from the mechanical action of the agitator and because the agitator work load sensing devices provide an accurate signature of agitator work load (for the purposes of determining optimal fill level) only after some water has been added to wet the articles. A standard predetermined initial fill level, an operator selected initial fill level, or an automatic initial fill level regime can be used to provide the initial fill commands to fluid supply system 140. To expedite the fill process and optimize the abilities of final fill determination system 170 (that is, requiring fewer rotation cycles of agitator 130 to accurately determine the optimal final fill level), it is desirable that the initial fill level correspond with the actual load of the articles in the basket to be washed in a particular wash cycle.

Initial fill estimation system 160 comprises an inertial load determination control subsystem, such as is described in copending application Ser. No. 08/406,424, filed 20 Mar., 1995, assigned to the assignee herein, and incorporated herein by reference. The inertial load determination system provides an estimate of clothes load prior to the addition of any water to the basket by spinning the basket to determine a normalized inertia of the washer basket loaded with articles to be cleaned and using that normalized inertia value to determine an estimated weight of the load of articles to be washed. A signal is then generated to control washer fluid supply system 140 to add a load-specific volume of water to the washer basket. In this way, the initial fill level is typically within a few inches of the final fill level and the time needed to determine the optimal fill level (using the program of final fill determination system 170) is reduced.

The spinning of basket 110 commanded by initial fill estimation system 160 results in the dry clothes being urged towards sidewall 114 of basket 110. As noted above, optimal operation of final fill determination system 170 is achieved when the articles in basket 110 are evenly distributed in the basket. In accordance with this invention, fill nozzle 180 and the clothes-positioning spray pattern emanating therefrom (especially first portion 191 of spray pattern 190 directed towards sidewall 114) serves to wash the articles down from the sidewall 114 so that the articles become evenly distributed in basket 110. Clothes-wetting spray pattern from nozzle 180 thus serves to evenly distribute the articles in basket 110 both preparatory to and during the rotation cycles commanded by final fill determination system 170.

In operation, washing machine 100 having control system 150 and fill funnel 180 in accordance with this invention is adapted to reliably determine the optimal water level for each load of articles that are placed into the machine to be cleansed. The initial load estimation system 160 spins the basket before the addition of water to determine an estimate of clothes load and hence command cleansing fluid supply system 140 to begin filling basket 110 to an initial fill level that corresponds with the estimate of clothes load. Final fill determining system uses measurements of agitator load during commanded rotations of the agitator to determine the optimal fill based on the relative amount of work required by the agitator to displace the articles and the water in the basket; the minimal amount of work to displace the articles and the water corresponds with the optimal fill level. Water is added to basket via fill funnel 180 that provides a clothes positioning spray pattern that serves to wet the clothing during the fill process, which serves to position the articles to be evenly distributed radially in the basket, which is conducive to obtaining the best results from final fill determining system 170. The combination of jogging the basket while filling with the clothes-positioning spray pattern wets all of the clothes in the basket, and, in combination with the rotation cycles of the agitator, serves to provide good mixing of the fill water with detergent that has been placed in the basket. The clothes positioning spray pattern is further useful during a rinse operation, such as with a spray rinse, in which basket 110 is rotating while fluid supply system is supplying the clothes positioning spray to the basket such that the articles in the basket receive a spray rinse that facilitates detergent reduction from the articles.

It will be apparent to those skilled in the art that, while the invention has been illustrated and described herein in accordance with the patent statutes, modifications and changes may be made in the disclosed embodiments without departing from the true spirit and scope of the invention. It is, therefore, to be understood that the appended claims are intended to cover all such modifications and changes as fall within the true spirit of the invention.

What is claimed is:

1. A washing machine for cleansing articles in a cleansing fluid, the machine comprising:

a rotatable basket adapted to receive the articles to be cleansed, a rotatable agitator device further being disposed within said basket to effect movement of cleansing fluid and articles within said basket;

a drive system coupled to respectively drive said rotatable basket and said agitator device;

a cleansing fluid supply system disposed to provide said cleansing fluid to said basket in a clothes-positioning spray pattern; and a closed loop water level controller responsive to the load of articles disposed in said basket to be cleansed, said water level controller being coupled to said cleansing fluid supply system and said drive system and adapted to provide an optimal fill level of cleansing fluid in said basket, said controller comprising a washer load determining system adapted to control rotation cycles of said agitator to displace said articles to be cleansed and to process information derived therefrom so as to determine said optimal fill level;

said cleansing fluid supply system further comprising a fluid fill funnel being disposed in a spraydown position with respect to said basket so as to provide said clothes-positioning spray pattern such that the articles in said basket are disposed so as to be displaced by said agitator during agitator rotation cycles to determine the load of said articles in the basket.

2. The machine of claim 1 wherein said fluid fill funnel comprises a nozzle formed to produce a fan discharge flow of fluid passing therethrough, said nozzle being selected from the group consisting of a flared nozzle having a waterfall-type flow and a spray head having a plurality of spray ports.

3. The machine of claim 2 wherein said washing machine comprises a vertical axis washer in which said basket has a rotation direction and said flared nozzle is disposed at a water addition station at a cant angle with respect to the direction of rotation of said basket so as to provide said clothes-positioning spray pattern.

4. The machine of claim 3 wherein said cant angle is measured with respect to a tangent line of the basket's direction of rotation at said water addition station, said cant angle being within the range between about 10° and about 30°.

5. The machine of claim 3 wherein said nozzle is disposed such that a first portion of the fluid passing therethrough in said clothes-positioning spray pattern is directed against a sidewall of said basket in a quadrant of said basket around said water addition station.

6. The machine of claim 5 wherein said nozzle is disposed such that said first portion of said fluid in said clothes-positioning spray is directed along a path such that said first portion of said fluid impinges on the side of said basket at a washdown position, said washdown position being at a position along the length of the sidewall between the midpoint and the top of said basket.

7. The machine of claim 3 wherein said nozzle is disposed such that a second portion of the fluid passing therethrough is directed along a path towards the center of said basket.

8. The machine of claim 7 wherein said second portion of said fluid is directed on a path to impinge on portions of said agitator disposed over the bottom of said basket.

9. A vertical axis washing machine comprising:

a rotatable basket adapted to receive the articles to be cleansed, a rotatable agitator device further being disposed within said basket to effect movement of water and articles within said basket;

a drive system coupled to said rotatable basket and said agitator device;

a water supply system disposed to provide water to said basket in a clothes-positioning spray pattern; and a closed loop water level controller responsive to the load of articles disposed in said basket to be cleansed, said water level controller being coupled to said water supply system and said drive system and adapted to provide an optimal fill level of water in said basket, said controller comprising an initial fill estimation system and a final fill determination system;

said drive system being responsive to said initial fill determination system so as to spin said basket prior to the addition of water to said basket;

said drive system further being responsive to said final fill determination system so as to rotate said agitator in rotation cycles of said agitator following the addition of water to said basket to displace said articles and water in said basket and to process agitator work information generated during said rotation cycles so as to determine said optimal fill level;

said water supply system further comprising a fluid fill funnel being disposed in a spraydown position with respect to said basket so as to provide said clothes-positioning spray pattern such that the water urges the articles in said basket to be distributed across the bottom of said basket.

10. The machine of claim 9 wherein said initial fill determination system comprises an inertia-based load estimation system.

11. The machine of claim 10 wherein said fluid fill funnel is disposed at a water addition station on said washer and oriented to provide a fan discharge flow of water of which at least a portion is directed toward a sidewall of said basket so as to rinse down articles disposed against said sidewall.

12. The machine of claim 11 wherein a portion of said fan discharge flow of water directed toward the sidewall of said basket passes along a path that intersects the sidewall of said basket at a washdown position in the upper half portion of the length of said sidewall between the bottom of the basket and the top of the basket.

13. The machine of claim 9 wherein said final fill determination system comprises an agitator minimum work point signal generator responsive to work expended by said agitator during rotation cycles.

14. The machine of claim 13 wherein said agitator comprises a plurality of vanes coupled to a central column such that rotation of said agitator causes a corresponding angular displacement of said vanes around said basket.

15. The machine of claim 14 wherein said fluid fill funnel is disposed at a water addition station on said washer and oriented to provide a fan discharge flow of water such that water passing therefrom is directed in a substantially evenly spaced pattern between said agitator and the sidewall of said basket.

16. The machine of claim 1 wherein said drive system is further responsive to said water level controller so as to rotate said basket incrementally during the addition of water to said basket.

* * * * *